US006098983A

United States Patent [19]

Kennedy

[11] Patent Number: 6,098,983

[45] Date of Patent: Aug. 8, 2000

[54] WORD GAME

[76] Inventor: Lovie Kennedy, 4440 Lane of Roses La., East Chicago, Ind. 46312

[21] Appl. No.: 08/998,744

[22] Filed: Dec. 29, 1997

[51] Int. Cl.[7] ..... A63F 3/00

[52] U.S. Cl. ..... 273/272; 273/432

[58] Field of Search ..... 273/272, 292, 273/429, 431

[56] References Cited

U.S. PATENT DOCUMENTS 3,195,895 7/1965 Kropinski .
3,746,342 7/1973 Fine .
4,923,199 5/1990 Hahn .
5,145,183 9/1992 Gates .
5,149,103 9/1992 Ross .
5,301,956 4/1994 Hernandez .

*Primary Examiner*—William M. Pierce

[57] ABSTRACT

A word game is provided including at least one sheet of paper having a top face, a bottom face, and a periphery formed therebetween. The top face of each sheet has a plurality of unique horizontally oriented words printed thereon. A large blank space is situated between each word. Also included is a time keeper for providing an indication upon the cessation of a predetermined amount of time.

2 Claims, 3 Drawing Sheets

INVENTION

| | | | |
|---|---|---|---|
| IN | NONE | VENT | VENTION |
| TIE | TON | TIN | TEN |
| NIVE | NOTE | NET | NOT |
| VET | VOTE | INN | NOTION |
| TO | VINE | IT | |

MARRIAGE

| | | | |
|---|---|---|---|
| GAME | RAGE | MAGE | AGE |
| ARM | RAM | RIG | GEAR |
| GEM | ARE | RIM | RIME |
| MARIE | MARGIE | AGIE | MORRIE |
| MAG | | | |

PRESIDENT

| | | | |
|---|---|---|---|
| DEN | DENT | DEER | DEEP |
| DIE | DIET | DIP | DIRE |
| SEE | SET | SIT | SIN |
| IT | SEEN | SENT | SEED |
| SIDE | SIP | REST | RENT |
| RED | RIDE | RIP | DIP |
| DEST | TIN | TEN | TEST |
| TIDE | TRIP | TEND | TIRE |
| TRIST | TENDER | ENTER | NET |
| NEST | NEED | PEND | PRESENT |
| RESIDE | PRIDE | PIN | PET |
| PRINT | REST | REP | DINE |
| ENTER | ED | NED | TED |
| DEE | PETE | PETER | |

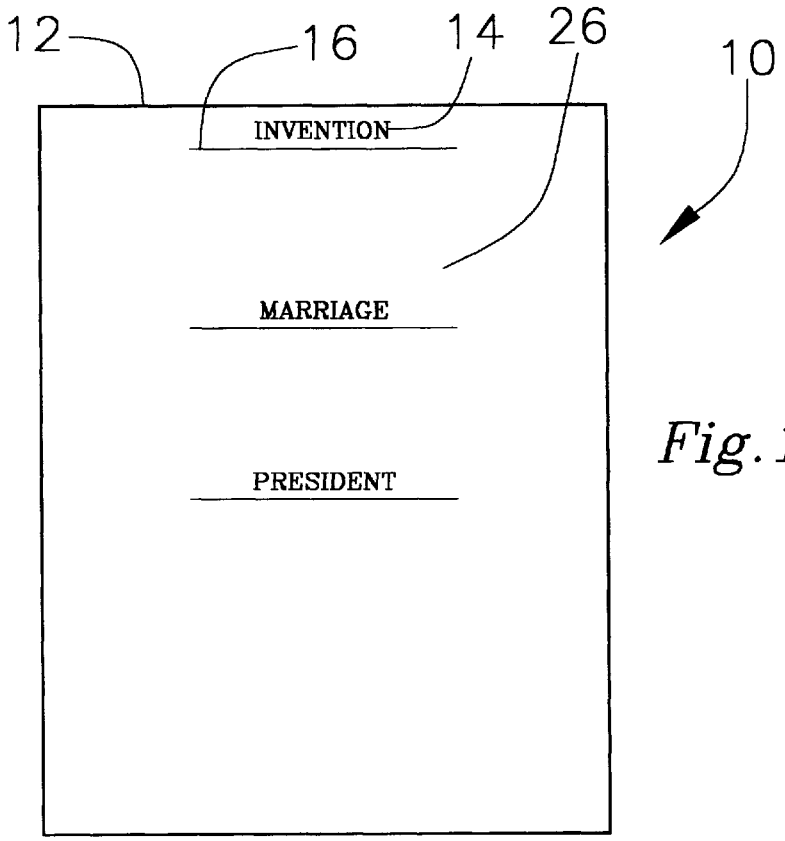

*Fig. 1a*

*Fig. 1b*

INVENTION

| | | | |
|---|---|---|---|
| IN | NONE | VENT | VENTION |
| TIE | TON | TIN | TEN |
| NIVE | NOTE | NET | NOT |
| VET | VOTE | INN | NOTION |
| TO | VINE | IT | |

MARRIAGE

| | | | |
|---|---|---|---|
| GAME | RAGE | MAGE | AGE |
| ARM | RAM | RIG | GEAR |
| GEM | ARE | RIM | RIME |
| MARIE | MARGIE | AGIE | MORRIE |
| MAG | | | |

PRESIDENT

| | | | |
|---|---|---|---|
| DEN | DENT | DEER | DEEP |
| DIE | DIET | DIP | DIRE |
| SEE | SET | SIT | SIN |
| IT | SEEN | SENT | SEED |
| SIDE | SIP | REST | RENT |
| RED | RIDE | RIP | DIP |
| DEST | TIN | TEN | TEST |
| TIDE | TRIP | TEND | TIRE |
| TRIST | TENDER | ENTER | NET |
| NEST | NEED | PEND | PRESENT |
| RESIDE | PRIDE | PIN | PET |
| PRINT | REST | REP | DINE |
| ENTER | ED | NED | TED |
| DEE | PETE | PETER | |

WORD GAME

BACKGROUND OF THE INVENTION

1. Field of the Invention

The present invention relates to a word game and more particularly pertains to providing a game with both entertainment and educational value.

2. Description of the Prior Art

The use of games is known in the prior art. More specifically, games heretofore devised and utilized for the purpose of providing entertainment are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,409,237; U.S. Pat. No. 5,310,346; U.S. Pat. No. 5,393,062; U.S. Pat. No. 5,312,112; and U.S. Pat. No. Des. 351,003.

In this respect, the word game according to the present invention substantially departs from the conventional concepts and designs of the prior art, and in so doing provides an apparatus primarily developed for the purpose of providing a game with both entertainment and educational value.

Therefore, it can be appreciated that there exists a continuing need for a new and improved word game which can be used for providing a game with both entertainment and educational value. In this regard, the present invention substantially fulfills this need.

SUMMARY OF THE INVENTION

In view of the foregoing disadvantages inherent in the known types of games now present in the prior art, the present invention provides an improved word game. As such, the general purpose of the present invention, which will be described subsequently in greater detail, is to provide a new and improved word game which has all the advantages of the prior art and none of the disadvantages.

To attain this, the present invention essentially comprises a plurality of sheets of paper. Each sheet of paper, or displaying means, is equipped with a rectangular configuration having a top face, a bottom face, and a periphery formed therebetween. The top face of each sheet has three unique horizontally oriented words printed thereon. Such words are further equally spaced with a horizontal line situated thereunder. As shown in FIGS. 1*a* & 2*a*, a large blank space is situated between each word. Also included is an hour glass having a top face and a bottom face fixed with respect to each other by way of a plurality of posts. A pair of sand reservoirs are situated between the faces and each have a reduced portion at a midpoint. During use, sand is situated within one of the reservoirs with such sand taking a predetermined amount of time to sift to the other reservoir, thus giving an indication of a cessation of the predetermined amount of time.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved word game which has all the advantages of the prior art games and none of the disadvantages.

It is another object of the present invention to provide a new and improved word game which may be easily and efficiently manufactured and marketed.

It is a further object of the present invention to provide a new and improved word game which is of a durable and reliable construction.

An even further object of the present invention is to provide a new and improved word game which is susceptible of a low cost of manufacture with regard to both materials and labor, and which accordingly is then susceptible of low prices of sale to the consuming public, thereby making such word game economically available to the buying public.

Still yet another object of the present invention is to provide a new and improved word game which provides in the apparatuses and methods of the prior art some of the advantages thereof, while simultaneously overcoming some of the disadvantages normally associated therewith.

Still another object of the present invention is to provide a game with both entertainment and educational value.

Lastly, it is an object of the present invention to provide a new and improved word game including at least one sheet of paper having a top face, a bottom face, and a periphery formed therebetween. The top face of each sheet has a plurality of unique horizontally oriented words printed thereon. A large blank space is situated between each word. Also included is a time keeper for providing an indication upon the cessation of a predetermined amount of time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 1*a* & 1*b* are perspective illustrations of one of the sheets of paper both before and after the method of the present invention is carried out.

Similar reference characters refer to similar parts throughout the several views of the drawings.

DESCRIPTION OF THE PREFERRED EMBODIMENT

Figure 2A:
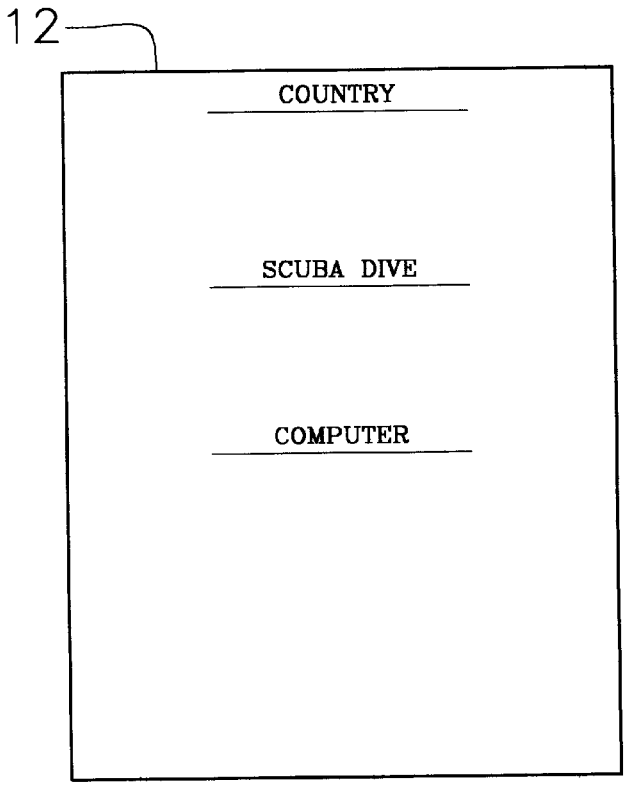
FIGS. 2*a* & 2*b* are perspective illustrations of another one of the sheets of paper both before and after the method of the present invention is carried out.
Figure 2B:
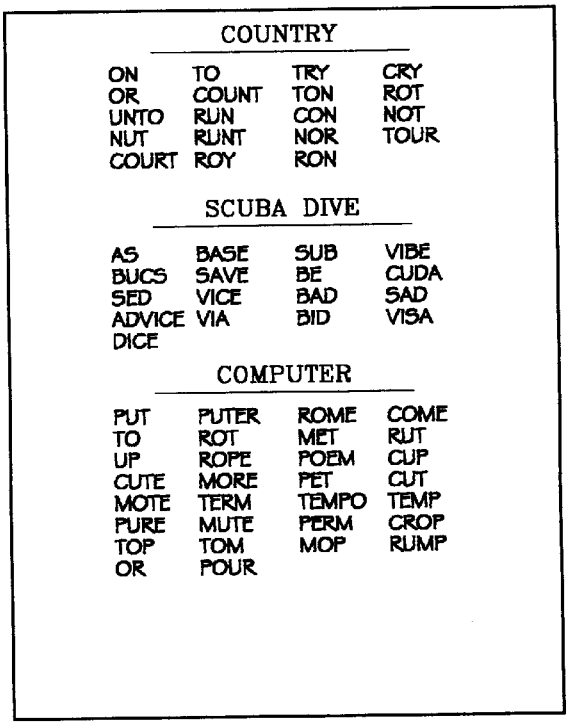
Figure 3:
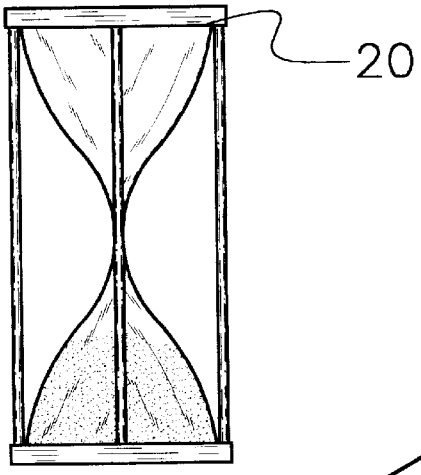
FIG. 3 is a side view of the hour glass.
Figure 4:
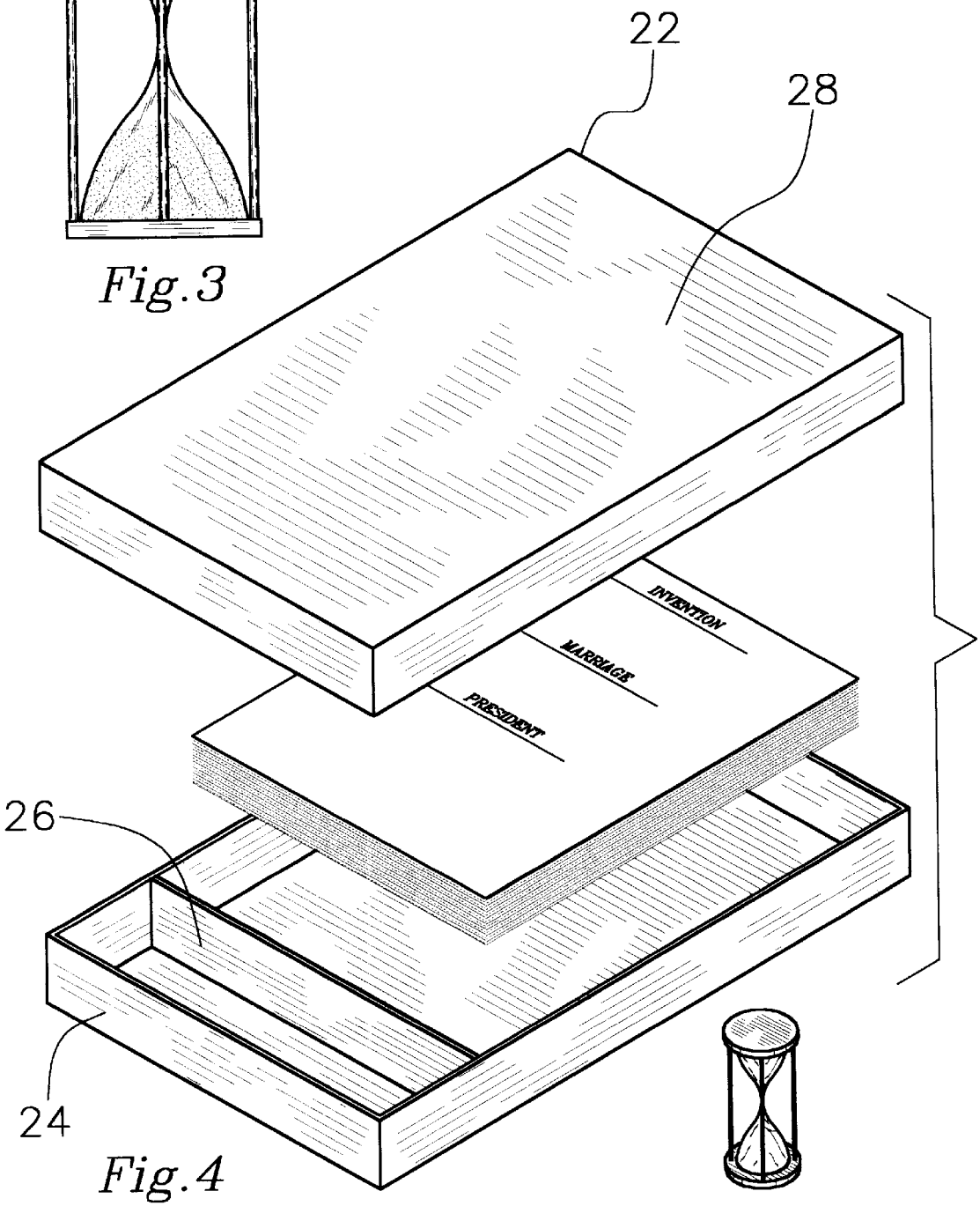
FIG. 4 is an exploded view of the various components of the present invention.

With reference now to the drawings, and in particular to FIG. 1 thereof, a new and improved word game embodying the principles and concepts of the present invention and generally designated by the reference numeral 10 will be described.

The present invention, the new and improved word game, is comprised of a plurality of components. Such components in their broadest context include a plurality of sheets of paper. Such components are individually configured and correlated with respect to each other so as to attain the desired objective.

More specifically, it will be noted that the system 10 of the present invention includes a plurality of sheets of paper 12. Each sheet of paper, or displaying means, is equipped with a rectangular configuration having a top face, a bottom face, and a periphery formed therebetween. The top face of each sheet has three unique horizontally oriented words 14 printed thereon. Such words are further equally spaced with a horizontal line 16 situated thereunder. As shown in FIGS. 1*a* & 2*a*, a large blank space 18 is situated between each word. In the preferred embodiment, every word of every sheet of paper is unique. Further, the black spaces each comprises of at least a 3 inch by 8 and ½ inch area. While not shown, a pencil, or recording means, is preferably provided to write words in the blank spaces.

Also included is an hour glass 20 having a top face and a bottom face fixed with respect to each other by way of a plurality of posts. A pair of sand reservoirs are situated between the faces and each have a reduced portion at a midpoint. During use, sand is situated within one of the reservoirs with such sand taking a predetermined amount of time to sift to the other reservoir, thus giving an indication of a cessation of the predetermined amount of time.

Finally, a box 22 is included having a bottom extent 24 with a rectangular bottom and a rectangular peripheral side wall integrally coupled to a periphery thereof and extending upwardly therefrom to define an interior space. The bottom extent further has a divider 26 with a planar rectangular configuration coupled within the peripheral side wall to define a pair of compartments. The box further includes a top extent 28 with a rectangular top and a rectangular peripheral side wall integrally coupled to a periphery thereof and extending downwardly therefrom to define an interior space. During use, the sheets of paper and hourglass may be situated in a separate one of the compartments and the top extent may be removably situated on the bottom extent for storing and transporting purposes.

The method associated with the present invention will now be set forth. First, a sheet of paper is distributed to each player at which time the hour glass is tipped to begin play. Once play has begun, each player writes as many words as possible on the corresponding sheet of paper under each word. It should be noted that the words printed in each space must be different combinations of the letters of the associated underlined word to define new unique words. Letters of the underlined word may not repeated in the same written word unless it is repeated in the underlined word. In other words, the number of letters of the words written in the blank spaces must have a number of letters less than or equal to the number of letters associated with the underlined word. Words from different spaces may be repeated. Upon the cessation of the predetermined amount of time, the written words on the sheet of each player are counted. The player with the most words wins. In alternate embodiments, the principles associated with the play of the present invention may be applied to computer games or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved word game comprising:

a plurality of sheets of paper each with a rectangular configuration having a top face, a bottom face, and a periphery formed therebetween, the top face of each sheet having three unique horizontally oriented words printed thereon and further equally spaced with an individual horizontal line situated under each of the words, wherein a large blank space is situated between each word;

a hour glass having a top face and a bottom face fixed with respect to each other by way of a plurality of posts with a pair of sand reservoirs situated therebetween each having a reduced portion at a midpoint, whereby sand situated within one of the reservoirs takes a predetermined amount of time to sift to the other reservoir; and a box having a bottom extent with a rectangular bottom and a rectangular peripheral side wall integrally coupled to a periphery thereof and extending upwardly therefrom to define an interior space, the bottom extent further having a divider with a planar rectangular configuration coupled within the peripheral side wall to define a pair of compartments, the box further including a top extent with a rectangular top and a rectangular peripheral side wall integrally coupled to a periphery thereof and extending downwardly therefrom to define an interior space, whereby the sheets of paper and hourglass may be situated in a separate one of the compartments and the top extent may be removably situated on the bottom extent for storing and transporting purposes.

2. A method of playing a word game comprising:

providing a recording means for storing a plurality of words, the recording means including a plurality of sheets of paper, each with a rectangular configuration having a top face, a bottom face, and a periphery formed therebetween;

providing a displaying means for depicting at least one word which includes a plurality of letters, the display means including three unique horizontally oriented words printed thereon and further equally spaced with an individual horizontal line situated under each of the words, wherein a large blank space is situated between each word;

providing a time keeping means for giving an indication upon the cessation of a predetermined amount of time, the time keeping means including an hour glass having a top face and a bottom face fixed with respect to each other by way of a plurality of posts with a pair of sand reservoirs situated therebetween each having a reduced portion at a midpoint, wherebv sand situated within one of the reservoirs takes a predetermined amount of time to sift to the other reservoir;

providing a box having a bottom extent with a rectangular bottom and a rectangular peripheral side wall integrally coupled to a periphery thereof and extending upwardly therefrom to define an interior space, the bottom extent further having a divider with a planar rectangular configuration coupled within the peripheral side wall to define a pair of compartments, the box further including a top extent with a rectangular top and a rectangular peripheral side wall integrally coupled to a periphery thereof and extending downwardly therefrom to define an interior space, whereby the sheets of paper and hourglass may be situated in a separate one of the compartments and the top extent may be removably situated on the bottom extent for storing and transporting purposes; and recording on the recorder means by at least one player as many words as possible prior to the cessation of the predetermined amount of time, wherein the words must be different combinations of the letters of the word to define new unique words with each combination.

* * * * *